US005253436A

United States Patent [19]

Mattiuzzo et al.

[11] Patent Number: 5,253,436

[45] Date of Patent: Oct. 19, 1993

[54] SKI BOOT WITH FOOT WEDGING MEANS

[75] Inventors: Mario Mattiuzzo, Treviso; Guido Robazza, Falze, both of Italy

[73] Assignee: Lange International S.A., Fribourg, Switzerland

[21] Appl. No.: 629,069

[22] Filed: Dec. 14, 1990

Related U.S. Application Data

[63] Continuation of Ser. No. 399,864, Aug. 29, 1989, abandoned.

[30] Foreign Application Priority Data

Oct. 11, 1988 [CH] Switzerland ..... 3790/88

[51] Int. Cl.[5] ..... A43B 5/04

[52] U.S. Cl. ..... 36/119; 36/88; 36/117

[58] Field of Search ..... 36/117-121, 36/88, 89, 93

[56] References Cited

U.S. PATENT DOCUMENTS

| | | | |
|---|---|---|---|
| 3,883,964 | 5/1975 | Check | 36/119 |
| 4,615,127 | 10/1986 | Delery | 36/119 X |

FOREIGN PATENT DOCUMENTS

| | | | |
|---|---|---|---|
| 0191368 | 8/1986 | European Pat. Off. | 36/117 |
| 0307745 | 3/1989 | European Pat. Off. | 36/117 |
| 0316605 | 5/1989 | European Pat. Off. | 36/117 |
| 3617121 | 4/1987 | Fed. Rep. of Germany | 36/119 |
| 3808652 | 11/1988 | Fed. Rep. of Germany | 36/117 |
| 2469885 | 5/1981 | France . | |

*Primary Examiner*—Paul T. Sewell
*Assistant Examiner*—Thomas P. Hilliard
*Attorney, Agent, or Firm*—Kane, Dalsimer, Sullivan, Kurucz, Levy, Eisele and Richard

[57] ABSTRACT

The ski boot comprising auxiliary means of wedging at least part of the foot, formed by at least one cam (10) mounted to rotate between the boot and the liner and actuatable from outside.

8 Claims, 3 Drawing Sheets

SKI BOOT WITH FOOT WEDGING MEANS

This is a continuation application of application Ser. No. 399,864, filed Aug. 29, 1989, now abandoned.

FIELD OF THE INVENTION

The present invention relates to a ski boot having an inner comfort liner and auxiliary means for wedging at least part of the foot, these means being adjustable from outside.

PRIOR ART

For correct guiding of the ski, it is essential that the skier's foot should be perfectly retained in the boot. It must, furthermore, likewise be head in place during forward flexion of the leg, which flexion tends to raise the heel. For this purpose, auxiliary means for retaining the heel and the metatarsus have already been proposed.

In respect of the wedging of the heel, it has already been proposed to narrow the boot in zones situated between the malleoli, the heel and the Achilles tendon, and to exert a pressure on these narrowed zones by means of two bearing members connected by a strap making it possible to exert a variable pressure on the narrowed zones and hence on the inner liner. Such a boot is described in Patent FR-2 334 315. The means used are relatively complex and bulky. They further require narrowing of the shell of the boot at a highly stressed position, which reduces its rigidity and renders it fragile. Bearing in mind these disadvantages, some designers have discarded such a solution in order to adopt a system of removable wedges mounted between the wall of the shank of the boot and the padding fixed to this shank, as described and shown in Patent Application FR-2 608 384.

Such wedges, however, are not directly adjustable by the user from outside the boot.

It is likewise known, in a boot put on from the rear which comprises a shell base on which a rear half-shank is articulated, to lock the heel by means of a screw device acting on a tongue fixed to the shell base (FR 2 562 395). Since the pressure is exerted centrally on the Achilles tendon, it is necessarily restricted. The Patent AT-385 185 likewise proposes the use of a screw device directed onto the Achilles tendon but acting on tongues via two arms. The device occupies a substantial volume in the boot. The two devices mentioned above do not, furthermore, make it possible to adjust the two sides of the heel differently.

It is likewise known to retain or wedge the metatarsus by means of a threaded rod which can be driven to rotate from outside and interact with a nut fixed to a strap extending over part of the circumference of the metatarsus (FR 2 548 877, FR 2 547 487 and FR 2 608 903). The threaded rod can likewise interact with two nuts which are respectively fixed to two straps or to two support plates (FR 2 469 885 and FR 2 381 483). These devices are relatively complicated and do not guarantee immobilization of the foot in the boot, or do so only against one of the inner lateral walls of the shell of the boot. These devices are, furthermore, sensitive to icing.

Returning to the idea of a wedging system which is directly adjustable from outside the boot, the object of the present invention is to perform this wedging by means which are as simple as possible, relatively insensitive to icing, continuously adjustable and capable of differentiated adjustment of the two sides of the heel and of the metatarsus respectively, when they are present on each side of the boot.

SUMMARY OF THE INVENTION

The boot according to the invention is a boot wherein the auxiliary wedging means are formed by at least one cam mounted to rotate between the boot and the liner and fixed to a pivot passing through the boot and provided, on the outside with a means permitting it to be driven in rotation.

According to an embodiment applied to a boot having a shell of synthetic material and comprising a shell base intended to Surround the foot and the heel and provided, at the rear, with a relatively flexible tongue extending upwards, and a shank in two parts whereof a rear part is articulated on the shell base, the cams are mounted on the rear part of the shank and act on the tongue of the shell base.

The drive means are formed, for example, by a screw slot making it possible to drive the cams in rotation by means of a coin.

BRIEF DESCRIPTION OF THE DRAWINGS

The attached drawing represents, by way of example, an embodiment of the invention.

DESCRIPTION OF THE PREFERRED EMBODIMENT(S)

Figure 1:
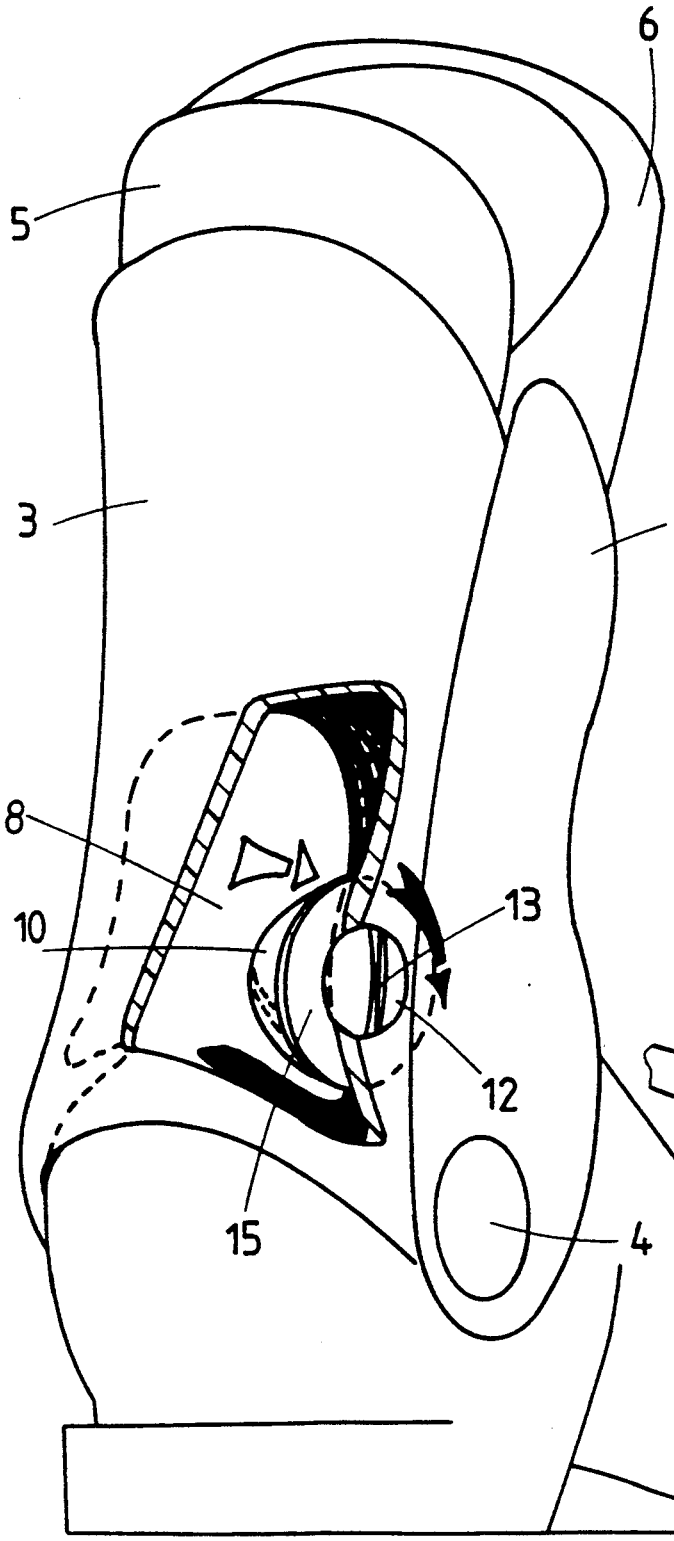
FIG. 1 is a perspective view of the rear of a boot having a cut-away showing one of the cams.
Figure 2:
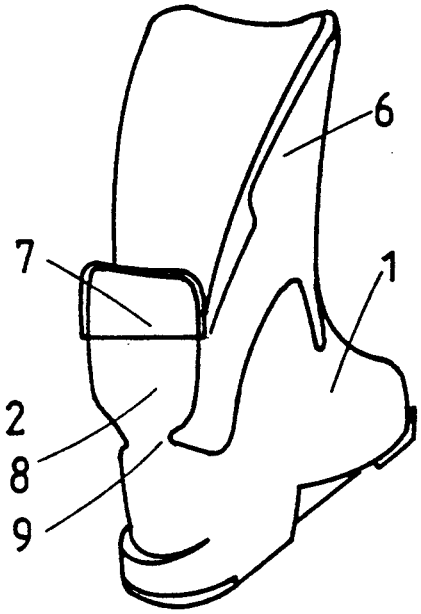
FIG. 2 shows diagrammatically the shell base and the inner liner, without the shank.
Figure 3:
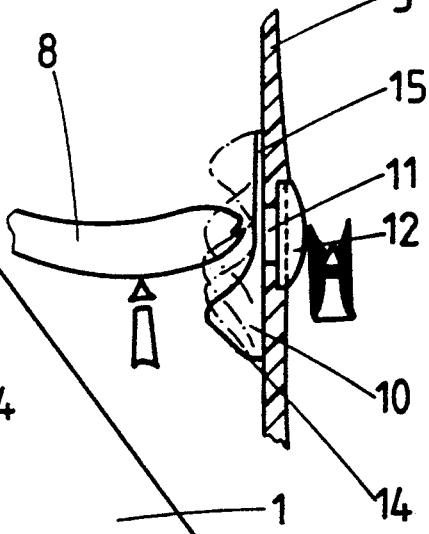
FIG. 3 is a view in axial section through the cam shown in FIG. 1.
Figure 1A:
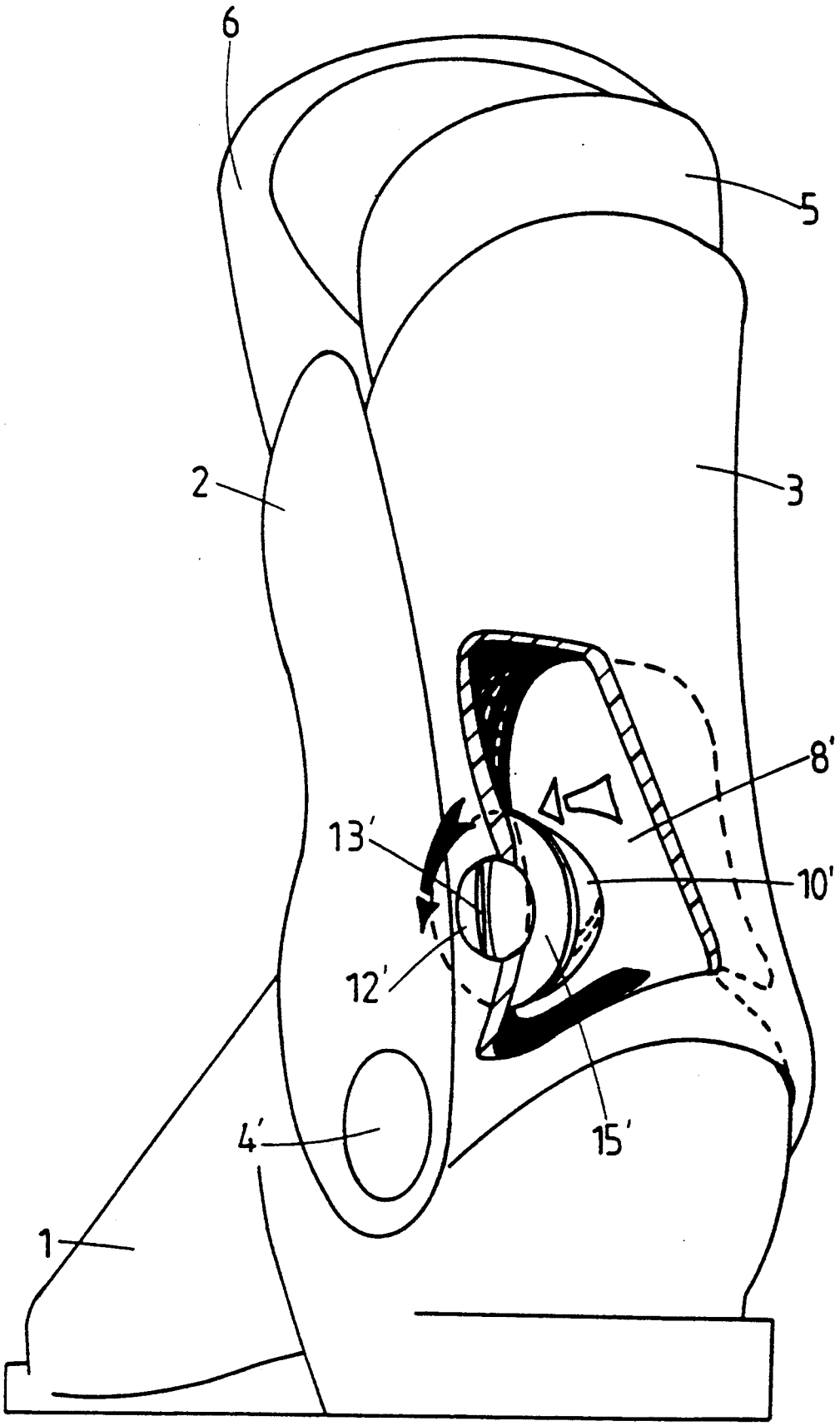

The boot shown is a boot having a shell comprising a shell base 1 of relatively rigid synthetic material surrounding the foot and the heel, and a shank articulated on this shell base 1, which shank possesses a front part 2 and a rear part 3, these two parts being articulated on the shell base at two opposing points whereof one, 4, is visible in the drawing. This type of boot, which is put on from the rear, is well known per se. The rear part 3 of the shank is provided with a padding 5 interacting with an inner liner 6 to ensure the comfort of the foot. As can be better seen in FIG. 2, the boot 6 is provided at the rear with a pocket 7 into which engages a relatively flexible tongue 8 fixed to the shell base 1 by a narrowed part 9, making it possible for the tongue to flex forwards and backwards and to adopt a more or less pronounced curvature.

On the rear part 3 of the shank, in two zones situated above the heel, on each side of the boot and each side of the part of the shank intended to come opposite the skier's Achilles tendon, are arranged two cams 10 whereof one can be seen in the drawing. The zones of the foot in question are, therefore, the zones delimited by the malleoli, the heel and the Achilles tendon. Each cam 10 is fixed to a pivot 11 passing through the wall of the rear part 3 of the shank and provided on the outside with a head 12 possessing a screw slot 13 to enable it to be driven by means of a coin or of a screw driver. The cam 10 possesses a boss 14 extending over about half the disc 15 forming the base of the cam and centered on the axis of the pivot 11. The cam could however have a different shape. It could for example have the shape of a bell cam such as is known in mechanical engineering. The essential factor is that, during rotation of the cam, the latter should gradually thrust inwards the side of the tongue 8, which thus closes on either side of the Achilles tendon. It is thus possible to wedge the heel perfectly.

The slight circumferential slope of the cam is sufficient in principle to prevent the reaction of the tongue 8 on the cam driving the latter to rotate. However, it is possible to provide a notching system to maintain the cam in the selected position.

The invention has been described in the case of a boot which is put on from the rear, but the cam system described can be fitted to any type of boot, with or without an articulated shank.

In the case of a boot having no tongue 8, the cams could act directly on the liner or on the padding fixed to the rear part of the shank. The cams could be fitted to a shell base. The cams could be driven to rotate by any means other than a screw slot.

The cams may be of metal or of hard plastic.

Figure 4:
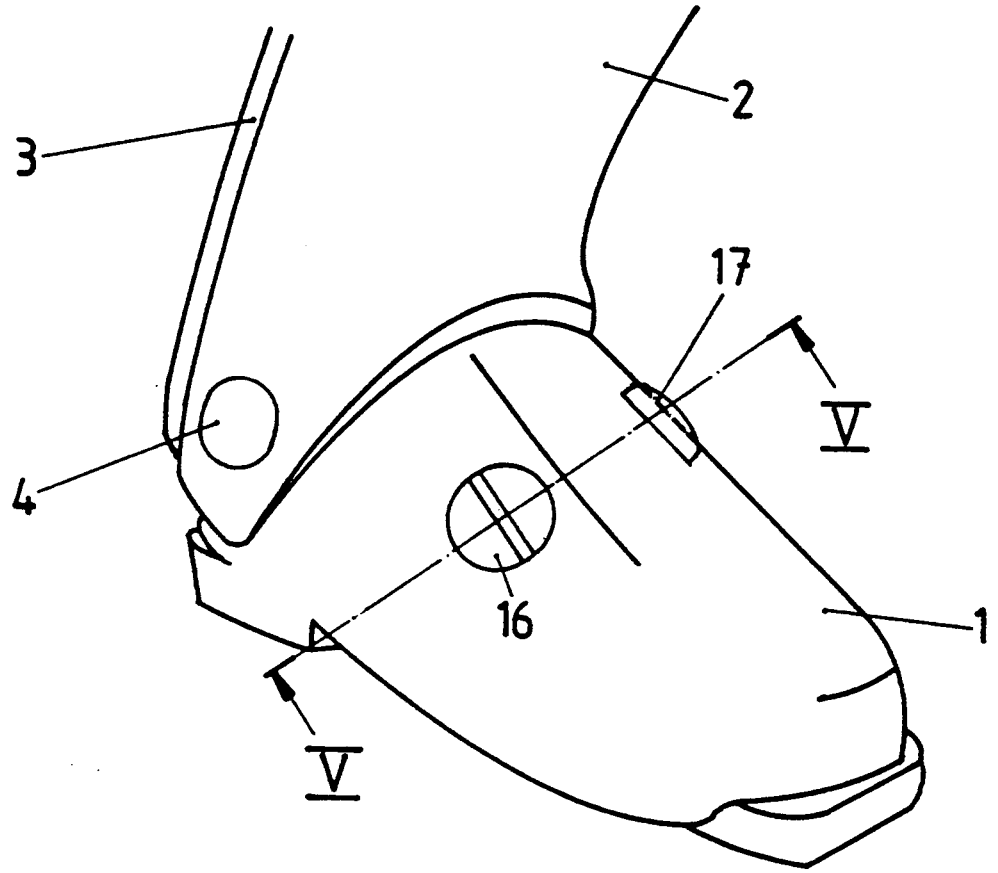
FIG. 4 is a perspective view of a boot equipped with cams for wedging on the metatarsus.
Figure 5:
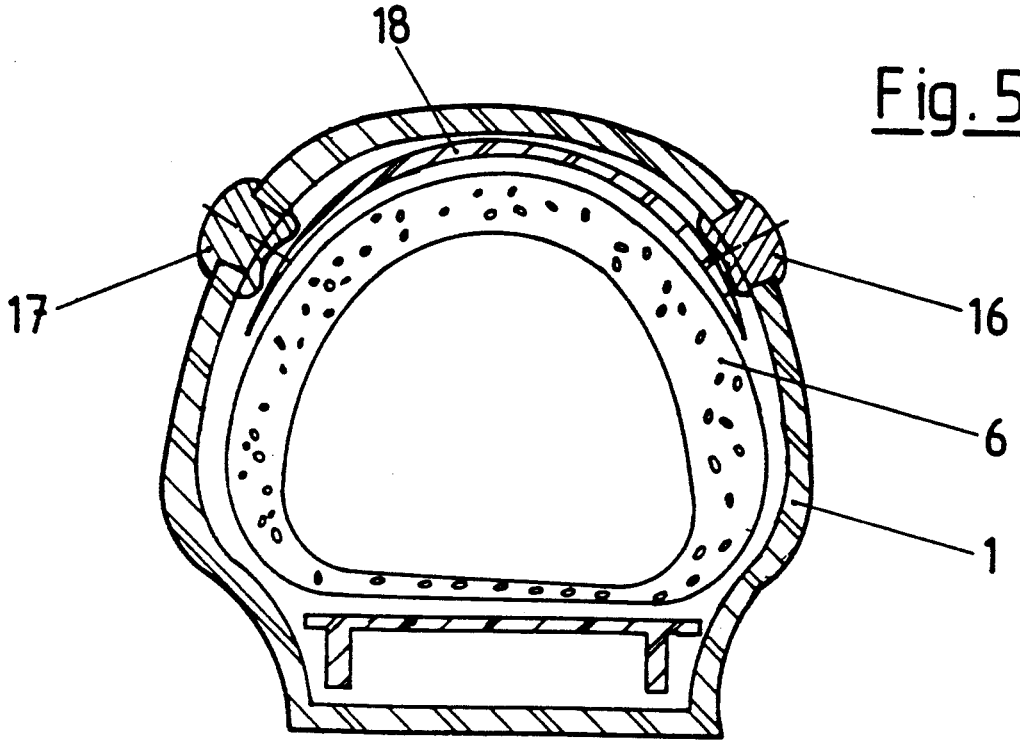
FIG. 5 is a view in cross-section along V—V in FIG. 4.

One or two cams analogous to the cams described above could likewise be used to wedge the metatarsus. An example is shown in FIGS. 4 and 5. The boot shown is equipped with two cams 16 and 17 mounted on the shell 1, on either side of the median vertical plane of this shell. The cams act on a flexible plate 18 mounted between the shell 1 and the comfort liner 6, the function of which is to distribute the pressure of the cams. This plate 18 is formed either by the extension of a pressure distributor covering the instep to distribute the pressure from a cord, or by a special plate which can be fixed by its end in the region of the heel. The action of the cams 16 and 17 makes it possible not only to wedge the foot in the boot but also to position the axis of the foot in an optimum manner for directing the ski.

We claim:

1. A ski boot having an inner comfort liner (6) and auxiliary means for wedging at least a part of the foot, these means being adjustable from the outside, wherein the auxiliary wedging means are formed by at least a pair of independent cams oppositely mounted on both lateral sides of the feet, said cams mounted to rotate axially between the boot and the liner and fixed to a pivot (11) passing through the boot and provided on the outside with a means (13) permitting it to be driven in rotation.

2. The boot as claimed in claim 1, wherein it comprises two cams mounted on either side of the part of the boot intended to come opposite the Achilles tendon.

3. The boot as claimed in claim 2, of synthetic material, comprising a shell base (1) intended to surround the foot and the heel and provided, at the rear, with a relatively flexible tongue (8) extending upwards, and a shank in two parts (2, 3) whereof a rear part (3) is articulated on the shell base, wherein the cams (10) are mounted on the rear part (3) of the shank and act on said tongue (8).

4. The ski boot having a shell as claimed in claim 1, wherein it comprises two cams mounted on the shell, on either side of the metatarsus, and a pressure distribution element arranged between the cams and the liner (6).

5. A ski boot having an inner comfort liner (6) and auxiliary means for wedging at least a part of the foot, these means being adjustable from the outside, wherein the auxiliary wedging means are formed by at least a pair of independent cams oppositely mounted on both lateral sides of the feet, said cams each being comprised of a boss forming a base of the cam, said cams mounted to rotate axially between the boot and the liner and fixed to a pivot (11) said base of the cam being oriented transverse to the axis of the pivot, said pivot passing through the boot and provided on the outside with a means permitting it to be driven in rotation.

6. The ski boot as set forth in claim 5 wherein the base of the cam is centered upon the axis of the pivot.

7. The ski boot as set forth in claim 5 wherein the independent cams are oppositely mounted on both sides of the feet in proximity to the region of the achilles tendon and the malleoli so as to permit adjustment in said region.

8. A ski boot comprised of a shell base of a synthetic material intended to surround the foot and heal, a flexible tongue attached to the rear of the boot which extends upwards, a two part shank having a front part and a rear part, the rear part being articulated to the shell base, auxiliary means for wedging at least a part of the foot, the means being adjustable from the outside, the means being formed by at least a pair of independent cams oppositely mounted on both sides of the feet on the part of the boot opposite the Achilles tendon, said cams mounted to rotate between the boot and the liner and fixed to a pivot passing through the boot and provided on the outside with a means permitting the cam to be driven in rotation, the cams being on the rear part of the shank and act upon the tongue.

* * * * *